US005588696A

United States Patent [19]

Jay et al.

[11] Patent Number: 5,588,696

[45] Date of Patent: Dec. 31, 1996

[54] CONVERTIBLE CHAIR WITH ARMRESTS WHICH CONVERTS TO A BACKPACK

[76] Inventors: John C. Jay, 18 Sea St., Manchester, Mass. 01944; Clay A. Burns, 8 Claremont Park #2, Boston, Mass. 02118

[21] Appl. No.: 496,450

[22] Filed: Jun. 29, 1995

[51] Int. Cl.[6] ..... A47C 4/42

[52] U.S. Cl. ..... 297/129; 297/28; 297/31; 224/155

[58] Field of Search ..... 297/27, 28, 31, 297/129; 224/155

[56] References Cited

U.S. PATENT DOCUMENTS

| | | | |
|---|---|---|---|
| D. 182,797 | 5/1958 | Ensign | 297/31 X |
| 2,490,367 | 12/1949 | Maddocks . | |
| 2,819,776 | 1/1958 | Balsam . | |
| 2,843,185 | 7/1958 | Clem et al. . | |
| 2,915,154 | 12/1959 | Holder . | |
| 2,973,888 | 3/1961 | Beardsley . | |
| 3,266,686 | 8/1966 | Griffith . | |
| 3,307,758 | 3/1967 | Platt . | |
| 3,309,134 | 3/1967 | Roberts . | |
| 3,404,915 | 10/1968 | De Souza Filho . | |
| 3,662,932 | 5/1972 | Kerschner . | |
| 3,828,992 | 8/1974 | Cerchione . | |
| 3,912,138 | 10/1975 | Pava . | |
| 3,947,903 | 4/1976 | Menke . | |
| 4,286,739 | 9/1981 | Silcott et al. . | |
| 4,300,707 | 11/1981 | Kjaer . | |
| 4,487,345 | 12/1984 | Pierce et al. . | |
| 4,518,198 | 5/1985 | Daniels . | |
| 4,530,451 | 7/1985 | Hamilton . | |
| 4,577,901 | 3/1986 | Phillips . | |
| 4,676,548 | 6/1987 | Bradbury . | |
| 4,687,248 | 8/1987 | Ross et al. . | |
| 4,747,526 | 5/1988 | Launes | 224/155 |
| 4,773,574 | 9/1988 | Burgard . | |
| 4,773,708 | 9/1988 | Nastu . | |
| 4,885,812 | 12/1989 | Lindner . | |
| 4,947,498 | 8/1990 | Van Boxtel . | |
| 4,955,517 | 9/1990 | Maresca . | |
| 5,016,792 | 5/1991 | Jay . | |
| 5,060,967 | 10/1991 | Hulterstrum | 297/16.1 X |
| 5,139,308 | 8/1992 | Ziman | 297/31 X |
| 5,209,381 | 5/1993 | Jay . | |
| 5,289,958 | 3/1994 | Jay | 224/155 |
| 5,303,975 | 4/1994 | Asato | 297/129 |
| 5,318,342 | 6/1994 | Hale | 297/129 |
| 5,381,941 | 1/1995 | Brune . | |
| 5,409,291 | 4/1995 | Lamb et al. . | |

FOREIGN PATENT DOCUMENTS

| | | | |
|---|---|---|---|
| 444159 | 3/1936 | United Kingdom | 297/28 |
| 503866 | 4/1939 | United Kingdom | 297/28 |

*Primary Examiner*—Peter R. Brown
*Attorney, Agent, or Firm*—Wolf, Greenfield & Sacks, P.C.

[57] ABSTRACT

A convertible backpack assembly for carrying items therewithin, yet providing a readily adaptable assembly for conversion into a beach-type chair. The assembly includes a front panel which is disposed generally parallel to a back panel when the assembly is in a backpack configuration. The front panel is rigidly attached to a base. The back panel is pivotally mounted to the base. Armrests are provided which extend forwardly from the back panel when the assembly is converted from a backpack configuration to a chair configuration. When the assembly is in the chair configuration, the armrests are adjustable to move the back panel between reclined and an upright positions. Webbing material is disposed over the frame portions to define the front and the back of the backpack as well as the back and seat of the chair. A bag made of a material such as canvas is placed between the front and back panels when the assembly is in the backpack configuration.

18 Claims, 5 Drawing Sheets

CONVERTIBLE CHAIR WITH ARMRESTS WHICH CONVERTS TO A BACKPACK

BACKGROUND OF THE INVENTION

This invention relates to a folding chair which readily converts into a backpack having a substantial load carrying capacity.

"Backpack" is defined as a camping pack usually made of canvas or nylon supported by a light metal frame and carried on the back. Backpacks normally have a carrying capacity of approximately 40 lbs. or more as distinct from knapsacks and tote bags that normally have a capacity in the range of 10 lbs. The present invention is both a backpack and a folding chair and performs both functions with equal facility.

An essential characteristic of an acceptable backpack is that it is comfortable when carried on the back even with a full load of 40 lbs. or more. It must be configured such that rigid frame members will not dig into the back of the carrier, and it must be properly balanced so as not to sag to the side or rearwardly away from the carrier's back. Furthermore, it must be convenient to use. The backpack of the present invention has all the above-mentioned characteristics. In addition, the backpack of this invention may easily and conveniently be converted into a comfortable chair when the main contents of the pack are removed. The following patents constitute relevant background in the field of the invention.

U.S. Pat. No. 4,687,248 discloses a tote bag that may be converted into a lounge chair. As a tote bag, its capacity is in the 10 lb. range rather than that of the backpack. As a tote bag, it is provided with handles which enable the bag to be hand carried and the device also has a single shoulder strap for alternatively carrying the tote bag on one side at waist height. The article is not a backpack nor does it have the capacity of a backpack.

U.S. Pat. No. 4,676,584 discloses a foldable beach-type chair that can be carried on the back by means of its shoulder straps, and the chair in turn has an external pack attached to it. The chair appears to have limited carrying capacity-capable of carrying less than 10 lbs. The rigid chair frame bears against the back and clearly would be uncomfortable when the device is carried on the back, especially when carrying a load.

U.S. Pat. No. 2,490,367 shows a folding chair that may be collapsed and carried by handles which are attached to it, and the sides of the seat and back may be attached so that the collapsed chair may serve as a hold-all. The device has limited carrying capacity as it has no depth and could not be comfortably carried on the back.

U.S. Pat. No. 4,773,547 discloses a foldable backpack-like frame that may be opened to form a small bench-type seat. The frame in turn has a separate carrying bag. This frame would be uncomfortable in the region of the lower back of the carrier as it has a rigid frame member that extends across the lower portion of the torso when the device is placed on the back and supported by shoulder straps.

U.S. Pat. No. 4,530,451 also discloses a storage bag attached to a foldable chair frame and is uncomfortable for the same reason as the structure of the '547 patent. Another pack is shown in U.S. Pat. No. 3,266,686, which utilizes chains and pivotal links to create a chair from a backpack frame.

U.S. Pat. No. 4,487,345 shows yet another folding (typically wood frame) chair with a container attached to its back.

This device would also be uncomfortable when carried on the back because of the configuration of the rigid frame.

U.S. Pat. No. 4,577,901 discloses a folding chair with carrier straps, and a cushioning pad to minimize discomfort to the lower back of the person carrying the chair. It obviously lacks the carrying capacity of a backpack.

U.S. Pat. No. 3,307,758 shows a backpack and a back rest in combination which includes ropes to hold the seat back together in proper supporting position. It is not a chair and does not support the occupant off the ground.

U.S. Pat. No. 3,662,932 discloses a box-like pack which converts to a stool. The frame includes components that unscrew from the pack and reattach to provide legs for the stool. The rigid frame members would be uncomfortable when carried on the back.

U.S. Pat. No. 4,286,739 discloses a backpack frame which when unfolded, makes up to a chair. The back portion hangs from the side rails of the back and does not form part of the seat support. Separate straps are provided for that purpose.

U.S. Pat. Nos. 5,209,381 and 5,289,958 issued to the present applicant bath disclose a backpack convertible chair. Each includes a frame portion which is carried on the back b,y straps. The frame portion comprises a front and rear panel. Cargo is stored between the front and rear panels inside the frame. While both of these references provide a very serviceable convertible backpack assembly, neither structure has armrests on the sides when the assembly is in the chair configuration.

The present invention provides a backpack convertible to a chair assembly with arms that afford easy access and provide a person seated in the chair maximum comfort.

BRIEF SUMMARY OF THE INVENTION

The present invention provides a backpack that employs a typical backpack frame that is contoured to the configuration of the wearer's back and is capable of carrying and distributing heavy loads on the wearer's back. The backpack frame is comfortable, adjustable for its carrier and readily convertible to an adjustable chair with arms. Thus the invention serves a dual purpose as it is capable of being used as a backpack and a chair. The invention is configured in such a manner that the frame provides a support for a heavy load when in the backpack mode and yet the frame does not impinge on the user when in the chair mode.

The backpack frame includes front and back frame panels which pivot with respect to each other. The frame panels are attached to a frame base. The front and back frame panels are enclosed in webbing envelopes that serve as the back and seat rest when the device is in the chair configuration.

The back panel is pivotally mounted on the frame base. The front frame panel is rigidly attached to the frame base. Armrests are pivotally mounted on the back frame. A bracket is attached to the end of each armrest remote from the pivot mount. Arm rest posts support the armrests and are pivotally mounted to the bracket. The armrest posts are also pivotally attached to the front frame.

The pivot connections are so arranged that to change the assembly from one configuration to the other it is only necessary to angularly displace the back frame panel relative to the front frame panel and the base. As a result, a comfortable and convenient backpack is provided which can be quickly converted to a chair. In the backpack configuration, the assembly is provided with two cross pieces that may be positioned comfortably against the back when the pack is carried by the shoulder straps. Additionally, woven strap handles are attached to the top of the front and back panels to enable the device to be carried conveniently for short distances.

BRIEF DESCRIPTION OF THE DRAWINGS

The advantages of the present invention will become more apparent when viewed in conjunction with the following drawings, in which.

DESCRIPTION OF THE PREFERRED EMBODIMENT

Figure 1A:
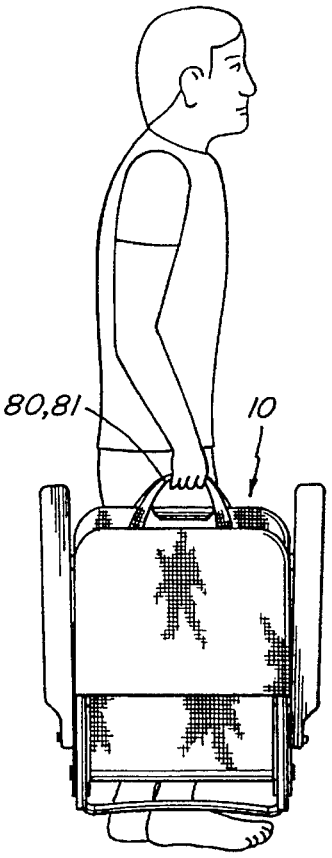
FIG. 1A is a schematic view of the invention in the backpack configuration being carried by hand straps.
Figure 1B:
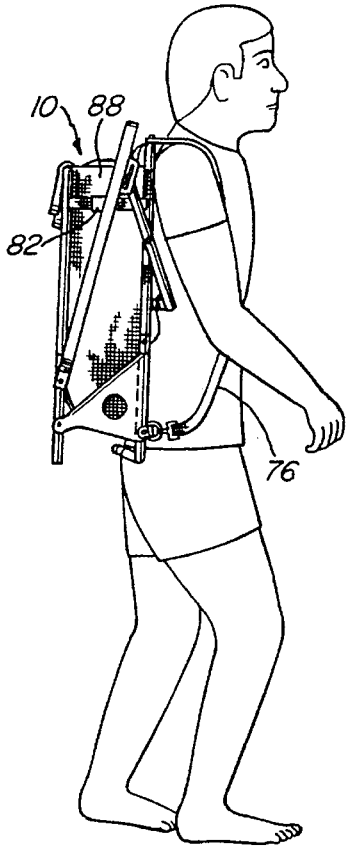
FIG. 1B is a schematic view of the invention in the backpack configuration being carried on the back of a person.
Figure 1C:
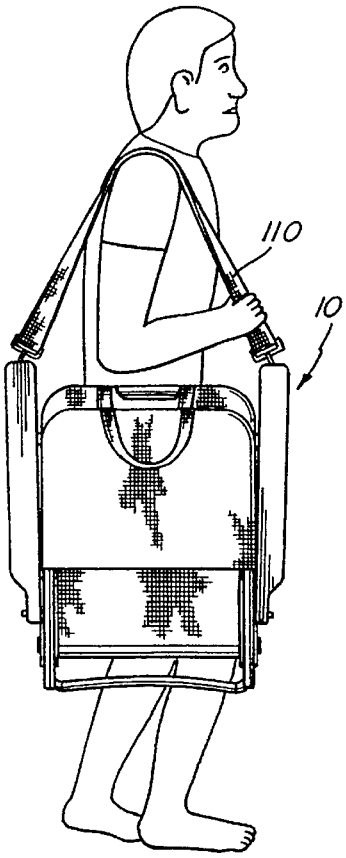
FIG. 1C is a schematic view of the invention in the backpack configuration and being carried by a shoulder strap.
Figure 2:
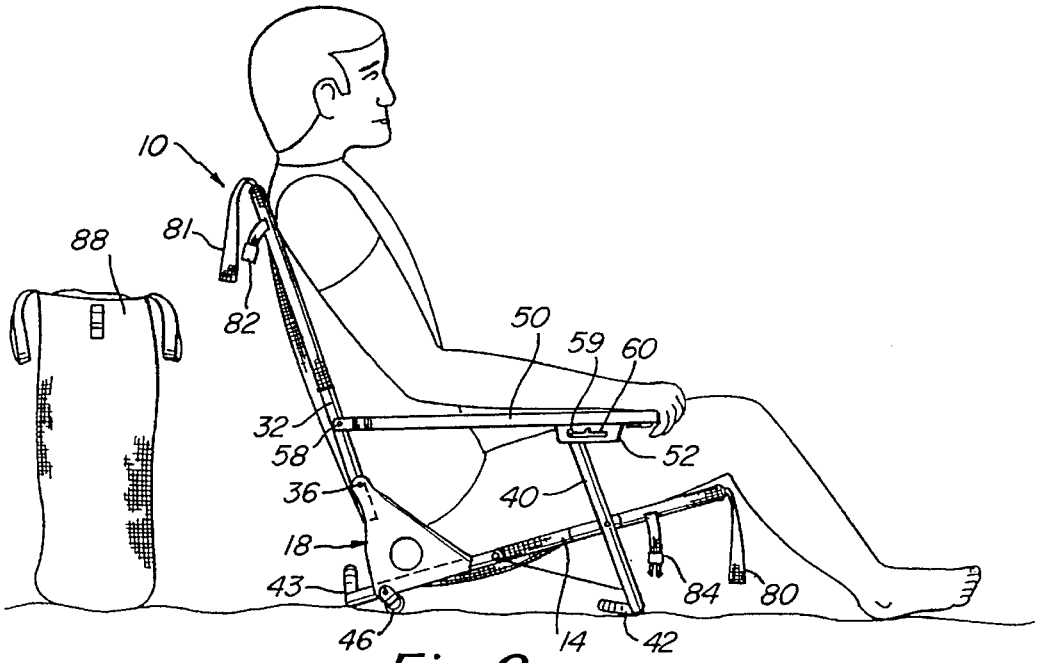
FIG. 2 is a schematic view of the invention in the chair configuration with a person seated in the chair.

Referring now to the drawings in detail, and particularly to FIGS. 1A, 1B, 1C and 2, there is shown a convertible backpack assembly 10 in its backpack and chair configurations, respectively. FIG. 1A is a schematic view of a person carrying the backpack using hand straps. As shown in FIG. 1 B, the convertible backpack assembly is adapted to be carried on the back of a person by means of straps 76, 77 (only strap 76 is shown in FIG. 1B). FIG. 1C depicts the unit being carried over one shoulder by a shoulder strap 100. The integrity of the backpack configuration is maintained by two separable buckles 82, 83. The buckles are released, after an internal bag 88 is removed to allow the unit to convert to a chair with arms, as shown in FIG. 2. The bag 88 is disposed within the backpack frame and holds various sundries which a user might desire to carry such as food, drinks, cooler, blanket, radio, sun umbrella, a towel, a book, and/or suntan lotion, etc. The backpack is designed to comfortably carry large and heavy loads over a distance. The particular details of the chair are discussed in detail below.

Figure 3:
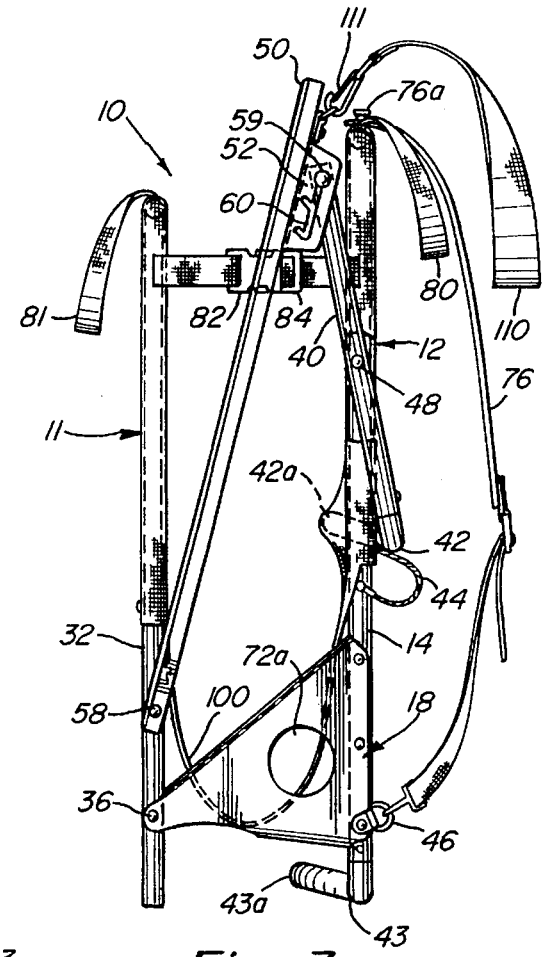
FIG. 3 is a side elevation view of the present invention in its backpack configuration.
Figure 4:
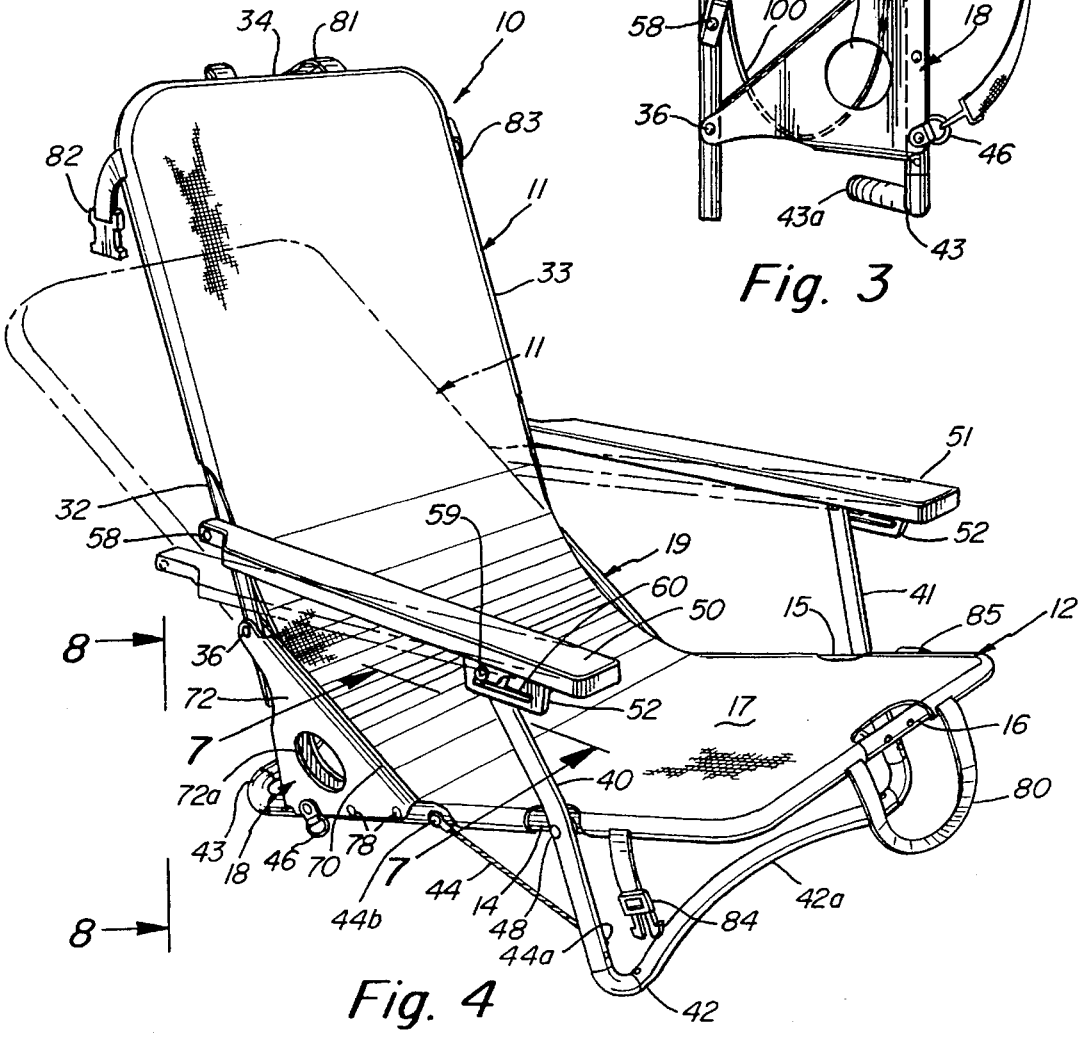
FIG. 4 is a perspective view of the present invention in the chair configuration and shown in full lines in the upright position and in broken lines in the reclined position.

Referring now to FIGS. 3 and 4, there is shown a convertible backpack assembly in its backpack and chair configurations, respectively. As readily seen in the figures, the left and right sides of the assembly are mirror images of one another. The convertible backpack assembly 10 includes a front frame panel 12 which is an inverted U-shape, and manufactured preferably from tubular aluminum or steel. The front panel 12 has two side bars 14, 15 and a front frame cross member 16. The lower ends of the side bars 14, 15 are respectively rigidly attached to frame bases 18 and 19, disposed on each side of the assembly. The frame base 18 is shown in detail in FIG. 8.

The back frame panel 11 is made up of two side bars 32, 33 and a back frame cross member 34. The lower end of the side bars 32, 33 are pivotally-connected to the base member 18 and 19 by base pins 36. The location of the pivot points on the side bars 32, 33 is such that when the assembly is in the backpack configuration the back frame panel 11 stands perpendicular to the ground and rests upon the ends of the side bars 32, 33, as shown in FIG. 3.

A one piece web envelope 17 is wrapped around the front and back frame panels 12 and 11. Attached to the web 17 are a pair of flexible handles 80, 81, one at the center of each of the front and back cross members 16, 34. The handles 80, 81 enable a person to pick up the assembly conveniently when it is in the backpack configuration. Additionally, releasable fasteners 82–85 are attached to the webbing on the upper portion of each side bar 32, 33, 14, 15, respectively. The fasteners keep the front and back panels from separating while the assembly is being used as a backpack. Of course, any suitable fastener for such a purpose may be used.

Figure 5:
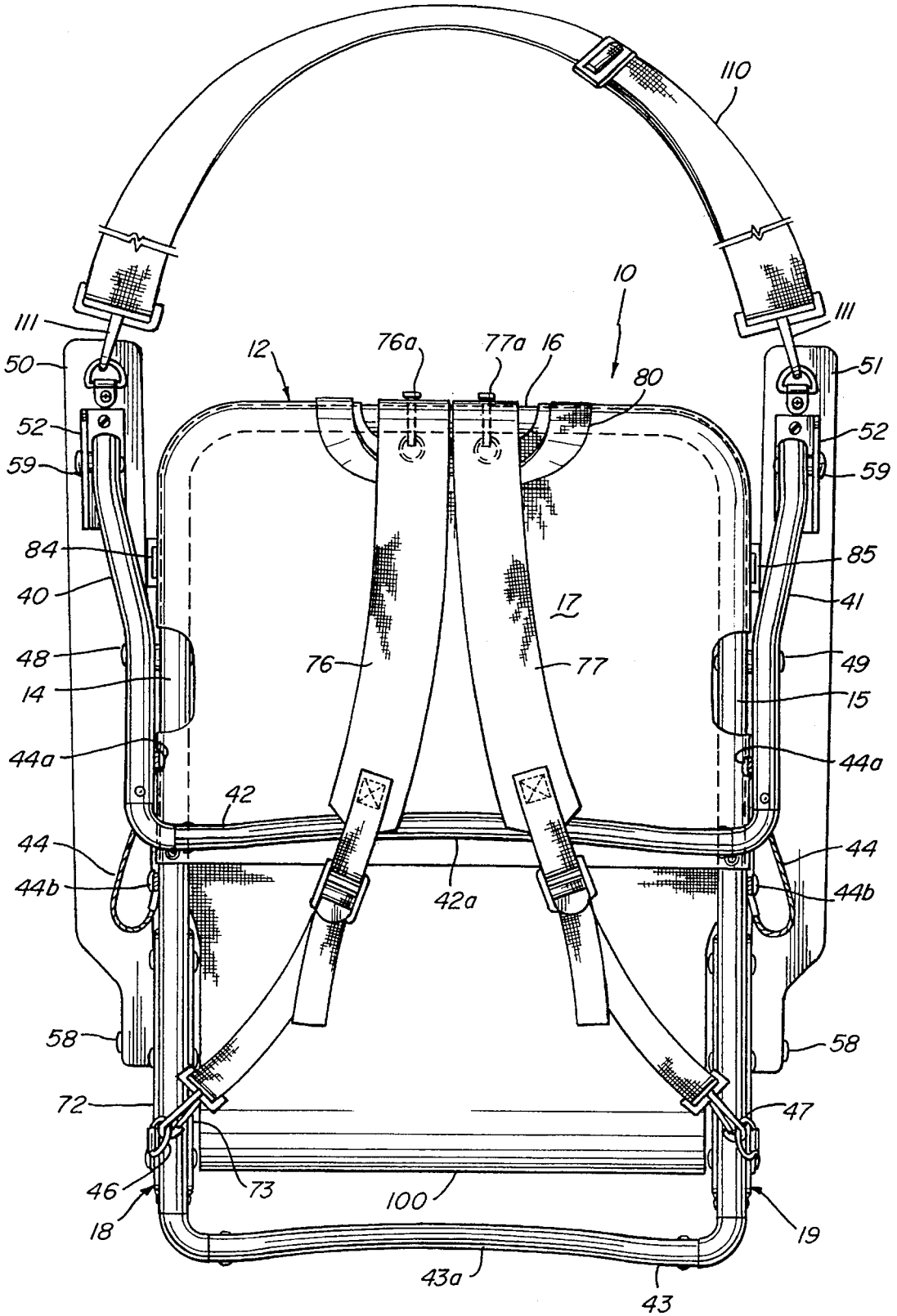
FIG. 5 is front elevation view of the assembly in its backpack configuration.

As shown in FIGS. 3 and 5, shoulder straps 76, 77 are attached to the front side of the assembly. The shoulder straps are omitted from FIG. 4 for clarity. One end of each strap 76, 77 is attached to the front frame panel cross member 16 by pins **76*a* and 77*a*, respectively. The other ends of the straps 76, 77 are connected to frame bases 18, 19, respectively, by loops 46 and 47**. The straps can be adjusted in a manner well known to those skilled in the art.

Figure 7:
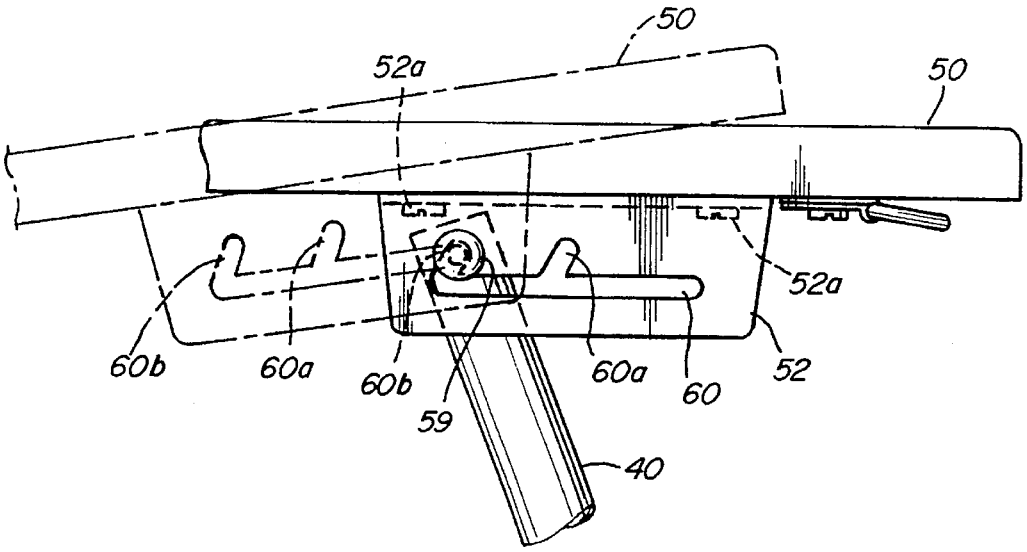
FIG. 7 is a detail view of the armrest and its supporting bracket in the upright position as viewed along line 7—7 of FIG. 4.

An armrest 50 is pivotally attached to side bar 32 of the back panel by a pin 58. The opposite end of the armrest carries a bracket 52 at its under side. The bracket 52 attaches the armrest to the armrest post and provides a means to recline the back panel. As shown in FIG. 7, the bracket 52 is affixed to the armrest by screws **52*a* and extends substantially perpendicular to the underside of the armrest. An elongate slot 60 in the bracket 52 which extends in a lengthwise direction with respect to the armrest is adapted to slidably receive a pin 59. The pin 59 is mounted on the upper end of the armrest bracket 40** and secures the armrest to the armrest bracket.

The chair is able to move between an upright and a reclined position when the pin slides in the slot. The slot 60 has two smaller slots **60*a*, 60*b* which extend towards the armrest. As shown in solid lines, the pin is adapted to be locked in the slot (60*b*, as shown) when the chair is upright. When he/she desires to recline, the user simply leans forward slightly and lifts the armrest and the pin travels the distance of the elongate slot 60. Once the pin in the location shown in dashed lines in FIG. 7, the chair is in a fully reclined position. When the pin is in the slot 60*a*** the chair is in an intermediate reclined position.

Figure 6:
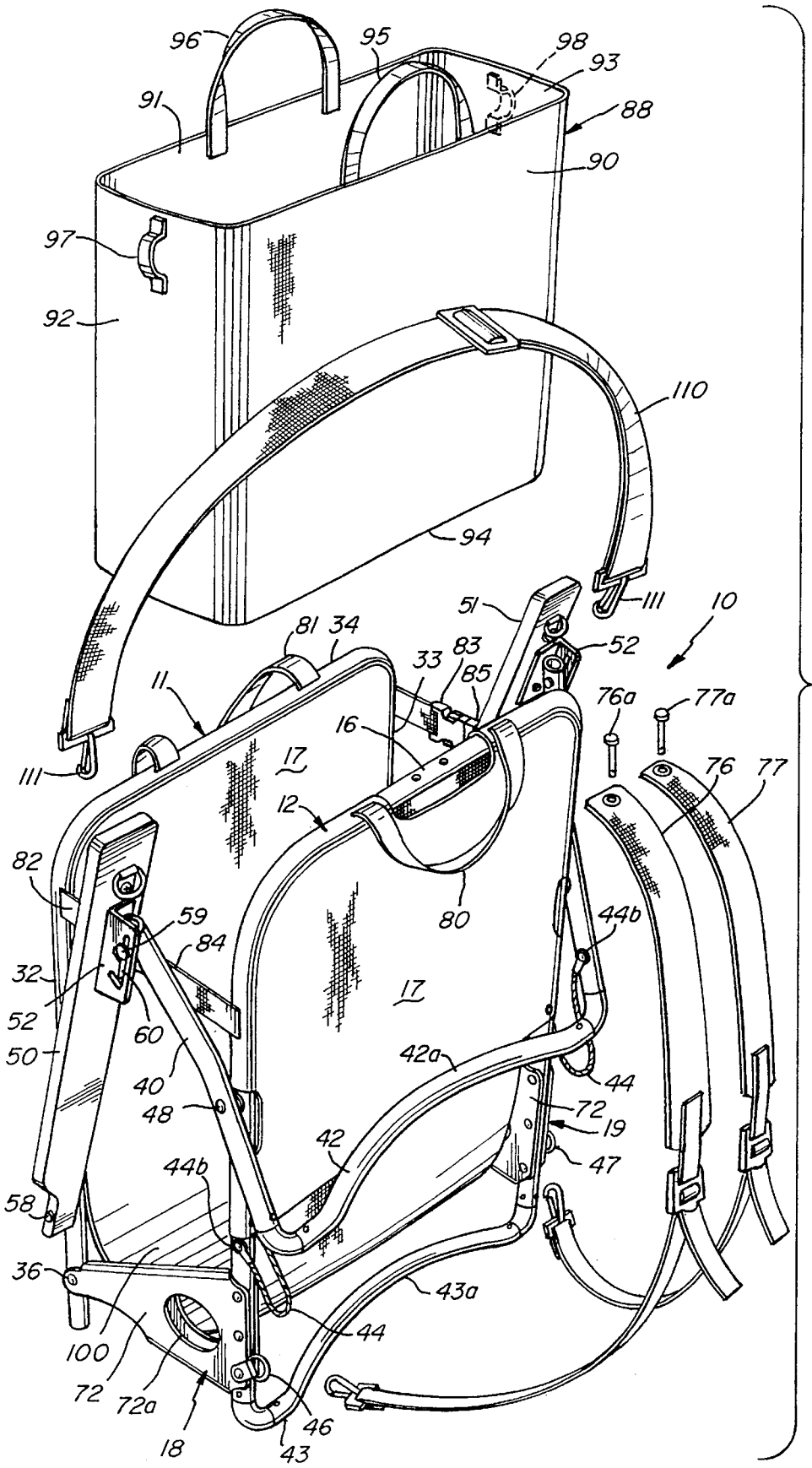
FIG. 6 is an exploded perspective view of the assembly in its backpack configuration.

The armrest posts 40, 41 are pivotally connected to the front frame panel side bars 14, 15 by pins 48, 49, respectively. As apparent by an inspection of FIGS. 4 and 5, the armrest posts are canted outward with respect to the seat. The outward canting increases the comfort of the chair for large people. A front cross tube 42 which rests on the ground when the device is in the chair configuration connects the lower ends of the armrest posts 40, 41. Similarly, a rear cross tube 43 connects the frame base members 18, 19. As shown in FIG. 6, the front and rear cross tubes have arcuate bends **42*a*, 43*a***, respectively, in their middle portions which generally conform to the shape of a person's back.

When the chair is moved from the backpack configuration shown in FIG. 3 to the chair configuration shown in FIGS. 2 and 4, the back frame panel 11 pivots away from the front frame panel on pins 36. With reference to FIG. 3, the pins 36, 58, 59 and 48 form the pivot points for a four bar linkage which enables the structure smoothly to change configuration between a backpack and a chair. When changing from a backpack to a chair, the side bar 32 pivots counterclockwise with respect to the base 18 on a pin 36. As the side bar 32 moves in the counterclockwise direction, the armrest pivots about hinge 58 and causes the bracket 52 and associated pin 59 to pull the armrest post 40 counterclockwise with respect to the front panel 12. A retaining wire 44 is attached to each armrest post at 44*a* and sidebars 14 and 15 at 44*b*, respectively, and limits the rotational movement of the armrest post about the front panel 12. The length of the retaining wire is sufficient to stop the rotational movement of the armrest post when the assembly is in its chair configuration and prevent the chair from collapsing. Additionally, when the assembly is in its reclined chair configuration, the lower ends of side bars 32 and 33 of the back panel 11 engage the bends of the base members 72 (described in detail below).

As shown in FIG. 6, an inner container 88 made of canvass or other similar material is provided to carry articles within the backpack assembly. The inner container 88 has front and back panels 90 and 91, and side panels 92 and 93 and a bottom 94. Flexible handles 95 and 96 are sewn to the tops of the front and back panels 90 and 91 to enable the contents of the backpack to be conveniently carried when removed from between the panels 11 and 12. Additionally, loops 97, 98 are provided on the side panels of the bag, which are adjacent the fastening members 82–85. The straps are positioned so that the fastening members can pass through the loops to keep the container from collapsing when the structure is in the backpack configuration and prevent the container 88 from being accidentally dislodged from the front and back panels.

Figure 8:
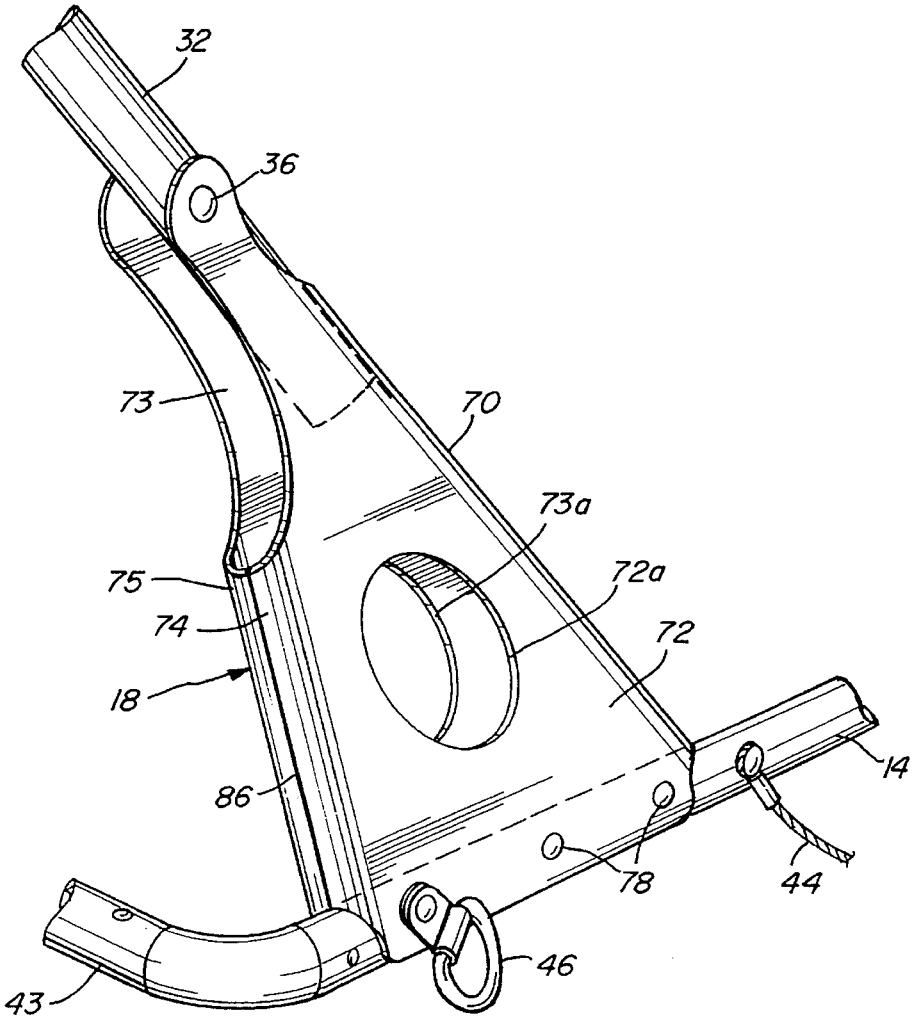
FIG. 8 is a perspective detail view of the base member in the reclining chair position as viewed along line 8—8 of FIG. 4.

FIG. 8 shows the right base member 18. A similar base member 19 is provided on the left side of the assembly (see FIG. 6). The base members 18, 19 define the rear legs of the assembly in the chair configuration, and support the front side of the assembly when the assembly is in the backpack configuration and resting on a support surface. The base member is a one piece sheet metal form which is bent about a radius at 70 to form two generally parallel plates 72, 73. Tabs 74, 75 are provided on each plate 72, 73. The bent tabs 74, 75 can be welded together at 86. Obviously, many different means may be used to connect them. The base member 18 is rigidly attached to the upright support 14 by rivets 78. Of course one skilled in the art will recognize the variety of means which may be used to rigidly attach the support 14 to the base member 18. The rivets and welds increase the strength of each base, and thus, the strength of entire assembly.

A strap 110 is removably attached to the forward ends of arms 50 and 51 by fasteners 111. The strap 110 provides a convenient way to carry the convertible chair across one shoulder.

Each base member is provided with a large hole 72*a* at its center portion to reduce the overall weight of the assembly while maintaining the desired strength and rigidity. The front side bars 14 and 15 are securely engaged by welding or other suitable means within the side portions of the base members such that the base members extend over approximately one third the length of the front side bars.

From the foregoing description, the many advantages of the present invention will be evident. When in the chair configuration, the structure provides a comfortable seat with arms and affords the user with the ability to select upright or reclined positions. The chair may very quickly and conveniently be converted to a backpack by closing the back and seat of the chair (the back and front panels 11 and 12) to the position shown in FIG. 6. The shoulder straps, if detached, may easily be reconnected to the frame as shown in FIG. 5. When the frame is closed, the carved configurations 42*a* and 43*a* of the cross tubes 42 and 43 provide comfortable supports for the backpack against the back of the person carrying it. The container 88 may very easily be slipped into position between the two panels 11 and 12 with its bottom 94 resting on the sling area 100 disposed between the lower ends of the two panels. The fastener 82–85 are inserted through the loops 97 and 98 on the side panels 92 and 93 of the container to retain it in place when the backpack is carried about. The container 88 can very quickly be removed from the backpack frame by unhooking the fasteners and slipping them out of the loops.

The overall shape of the backpack is very comfortable when worn on the back of a person because its overall shape and dimensions are designed to accommodate the physique of the average person. In the preferred embodiment illustrated, the backpack is approximately 9 inches deep, 22 inches high and 20 inches wide. The limited depth equal to approximately half the height of panels 11 and 12 provides excellent balance for the assembly.

It will be evident to those skilled in the art that numerous modifications of the structure may be made without departing from the spirit of this invention. Therefore, it is not intended that the scope of this invention be limited to the specific embodiment shown and described. Rather, it's scope is to be determined by the appended claims and their equivalents.

What is claimed is:

1. A backpack assembly which is convertible to a multi-position chair comprising:

generally parallel front and back panels having tops and bottoms, said front panel intended to be closer to the back of a person carrying the assembly as a backpack;

said front panel including a front cross bar and left and right front vertical side bars lying in a first plane, said back panel having a back cross bar and left and right back vertical side bars lying in a second plane;

left and right base members each rigidly attached to a lower portion of the left and right side bars of the front panel, respectively; and pivotally attached to the lower portion of each left and right side bar of the back panel, respectively; said base members establishing a substantial gap between the front and back panels when the assembly is in the backpack configuration defining the substantial carrying volume of the backpack;

at least one strap attached to the assembly for mounting the assembly on a person's back;

rigid cross member having ends rigidly attached to each side bar of said front panel and forming a bottom support when the assembly is configured as a backpack; said cross member forming a ground based leg support when the assembly is configured as a chair;

left and right armrests, one each pivotally mounted to the back panel side bars, a bracket mounted on each of the left and right armrests at the ends of the armrests remote from the pivot mounts, each bracket having an elongated aperture; and left and right armrest posts each having one end pivotally engaged with the apertures of the left and right armrest brackets, respectively, and a central portion pivotally attached to the left and right side bars of the front panel, whereby the assembly changes into a chair configuration when the back panel is angularly displaced relative to the front panel.

2. The backpack assembly as defined in claim 1, wherein the armrest posts are canted outwardly with respect to the chair at the one end pivotally engaged with the left and right armrest brackets, respectively.

3. The backpack assembly as defined in claim 1, wherein at least one fabric envelope encloses the frame at the front and back panels.

4. The backpack assembly as defined in claim 1, wherein the armrest posts are rigidly interconnected by a forward cross member.

5. The backpack assembly as defined in claim 4, wherein the cross member connected to the side bars of the front panels and the forward cross member each have an arcuate bend, said arcuate bend conforming to the back of a person carrying the assembly as a backpack.

6. The backpack assembly as defined in claim 1, further comprising a container having front, back and side walls and a bottom wall disposed between the front and back panels when the assembly is in the backpack configuration.

7. The backpack assembly as defined in claim 1, wherein each base member further comprises two side portions and side bars of the front and rear panels are disposed between the two side portions.

8. The backpack assembly as defined in claim 1, wherein the engagement of the pivotal connections of the armrest posts with the elongated apertures allow the back portion to be adjusted into a plurality of different positions.

9. A chair assembly which is convertible into a backpack comprising:

front and back panels;

said front panel being closer to the ground when the assembly is in the configuration of a chair;

said front panel including right and left front side bars and a front cross bar lying in a first plane;

said back panel including right and left back side bars and a back cross bar lying in a second plane;

right and left base members each rigidly attached to the right and left side bars of the front panel, respectively, said right and left base members pivotally attached to the right and left side bars of the back panel, respectively; said base members establishing a substantial gap between the panels defining the carrying volume of the backpack when the assembly is in the backpack configuration;

right and left armrests having front and rear ends, said rear ends being pivotally attached to the right and left side bars of the back panel, respectively; a bracket mounted on each armrest toward the front end of each armrest;

right and left armrest posts each having one end pivotally mounted to the right and left armrest bracket, respectively; and a central portion pivotally attached to the right and left side bars of the front panel;

a retaining wire attached to each armrest post below the pivot point with the front panel and also attached to each corresponding left and right side bar of the front panel rearwardly of the pivot point on the front panel bars for preventing the chair from opening beyond a predetermined point, and wherein the back panel and arms are movable relative to the front panel such that the chair may be collapsed into the backpack configuration.

10. The chair assembly is defined in claim 9, wherein at least one fabric envelope enclosing the frame in the front and back panels.

11. The chair assembly as defined in claim 9, wherein the armrest posts are rigidly connected at a lower end by a forward cross member.

12. The chair assembly as defined in claim 11, wherein the forward cross member has an arcuate bend, said arcuate bend conforming to the back of a person carrying the assembly when in the backpack configuration.

13. The chair assembly as defined in claim 9, further comprising a container having front, back and sidewalls and a bottom wall disposed between the front and back panels when the assembly is in the backpack configuration.

14. The chair assembly as defined in claim 9, wherein each base member further comprises two side portions and the side bars of the front and rear panels are disposed between the two side portions.

15. The chair assembly as defined in claim 9, wherein the pivotal connection between the brackets and the side bars of the back panel are configured to allow the back panel to recline into more than one position.

16. The chair assembly as defined in claim 9, wherein the arm rest posts are canted outwardly with respect to the chair at the one end engaged with the left and right armrest brackets, respectively.

17. The chair assembly as defined in claim 9, wherein the arms are flaired outwardly with respect to the chair from the attachment to the left and right side bars, respectively.

18. The chair assembly recited in claim 9 further comprising a shoulder strap attached to the chair which is adapted to carry the chair assembly over a shoulder when the chair is converted into a backpack.

* * * * *